US011467613B2

(12) United States Patent
Zukowski et al.

(10) Patent No.: US 11,467,613 B2
(45) Date of Patent: Oct. 11, 2022

(54) ADAPTABLE LOW DROPOUT (LDO) VOLTAGE REGULATOR AND METHOD THEREFOR

(71) Applicant: SEMICONDUCTOR COMPONENTS INDUSTRIES, LLC, Phoenix, AZ (US)

(72) Inventors: Kyle Zukowski, Scottsdale, AZ (US); Leonardo Kiyosi Bogaz Mitsuyuki, Chandler, AZ (US); Didier Margairaz, San Jose, CA (US)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 47 days.

(21) Appl. No.: 16/949,249

(22) Filed: Oct. 21, 2020

(65) Prior Publication Data

US 2022/0019253 A1 Jan. 20, 2022

Related U.S. Application Data

(60) Provisional application No. 63/052,309, filed on Jul. 15, 2020.

(51) Int. Cl.

| | |
|---|---|
| ***G05F 1/575*** | (2006.01) |
| ***G05F 1/46*** | (2006.01) |
| ***G05F 1/445*** | (2006.01) |

(52) U.S. Cl.

CPC ..... *G05F 1/575* (2013.01); *G05F 1/445* (2013.01); *G05F 1/461* (2013.01); *G05F 1/468* (2013.01)

(58) Field of Classification Search

CPC ..... G05F 1/462; G05F 1/465; G05F 1/468; G05F 1/56; G05F 1/575; G05F 1/562;

(Continued)

(56) References Cited

U.S. PATENT DOCUMENTS 5,852,359 A * 12/1998 Callahan, Jr. ..... G05F 1/575 323/280
6,765,374 B1 * 7/2004 Yang ..... G05F 1/575 323/280

(Continued)

FOREIGN PATENT DOCUMENTS

WO WO-2014191787 A1 * 12/2014 ..... G05F 1/56

OTHER PUBLICATIONS

Abhijith Arakali, Srikanth Gondi and Pavan Kumar Hanumolu; "A 0.5-to-2.5GHz Supply-Regulated PLL with Noise Sensitivity of −28dB"; White Paper; IEEE 2008 Custom Intergrated Circuits Conference (CICC); San Jose, California, USA; Sep. 21-24; 4 pages.

(Continued)

*Primary Examiner* — Kevin J Comber
*Assistant Examiner* — Nusrat Quddus
(74) *Attorney, Agent, or Firm* — Maschoff Brennan

(57) ABSTRACT

An adaptable LDO regulator includes an error amplifier providing an error voltage according to a difference between a feedback voltage and a reference voltage, first and second pass transistors each having a first current electrode for receiving an input voltage, a control electrode for receiving the error voltage, and a second current electrode, the second current electrode of the second pass transistor providing an output voltage, a voltage divider generating the feedback voltage in response to a voltage on an input thereof, and a mode selection network that in a closed loop mode, couples the second current electrodes of the first and second pass transistors together and to the input of the voltage divider, and in an open loop mode, couples the second current electrode of the first pass transistor to the input of the voltage divider and decouples the second current electrodes of the first and second pass transistors.

28 Claims, 6 Drawing Sheets

(58) Field of Classification Search
CPC ..... G05F 1/565; G05F 1/567; G05F 1/569; G05F 1/571; G05F 1/573; G05F 1/5735; G05F 3/10; G05F 3/16; G05F 3/18; G05F 3/185; G05F 3/20; G05F 3/26; G05F 3/30; G05F 3/205; G05F 3/22; G05F 3/24; G05F 3/222; G05F 3/242; G05F 3/225; G05F 3/227; G05F 3/245; G05F 3/247; G05F 3/262; G05F 3/265; G05F 3/267; G05F 1/463; G05F 1/46; G05F 1/461
USPC ..... 323/271–289
See application file for complete search history.

(56) References Cited

U.S. PATENT DOCUMENTS 6,861,827 B1 * 3/2005 Yang ..... G05F 1/575 323/280
7,253,589 B1 * 8/2007 Potanin ..... H02J 7/00309 320/144
7,675,273 B2 * 3/2010 Ko ..... G05F 1/575 323/269
8,169,203 B1 * 5/2012 Vemula ..... G05F 1/575 323/273
8,289,009 B1 * 10/2012 Strik ..... G05F 1/575 323/280
8,536,844 B1 * 9/2013 Kumar ..... G05F 1/565 323/273
10,069,410 B1 * 9/2018 Chang ..... G05F 1/56
10,310,530 B1 * 6/2019 Lu ..... G05F 1/468
10,459,468 B1 * 10/2019 Ankamreddi ..... H03K 17/0822
10,649,479 B2 * 5/2020 Heo ..... G05F 1/59
2005/0242796 A1 * 11/2005 Yang ..... G05F 1/575 323/282
2006/0226821 A1 * 10/2006 Whittaker ..... G05F 1/575 323/282
2011/0248688 A1 * 10/2011 Iacob ..... G05F 1/56 323/234
2012/0161733 A1 * 6/2012 Hua ..... G05F 1/565 323/282
2012/0262137 A1 * 10/2012 Arigliano ..... G05F 1/573 323/277
2013/0069608 A1 * 3/2013 Gakhar ..... G05F 1/575 323/273
2013/0076325 A1 * 3/2013 Liu ..... G05F 1/575 323/280
2014/0312864 A1 * 10/2014 Patel ..... G05F 1/461 323/273
2016/0098050 A1 * 4/2016 Enjalbert ..... G05F 1/575 323/280
2017/0052552 A1 * 2/2017 Mahmoudi ..... G05F 1/575
2019/0302820 A1 * 10/2019 Yasusaka ..... G05F 1/575
2021/0026385 A1 * 1/2021 Park ..... G05F 1/573

OTHER PUBLICATIONS

Thomas Toifl, Christian Menolfi, Peter Buchmann, Marcel Kossel, Thomas Morf and Martin L. Schmatz; A 1.25-5GHz Clock Generator With High-Bandwidth Supply-Rejection Using a Regulated-Replica Regulator in 45-nm CMOS; White Paper; IEEE Journal of Solid State Circuits; vol. 44; No. 11; Nov. 2009; 10 pages.
Saad Bin Nasir, Shreyas Sen and Arijit Raychowdhury; "A Reconfigurable Hybrid Low Dropout Voltage Regulator for Wide-Range Power Supply Noise Rejection and Energy-Efficiency Trade-Off"; White Paper; IEEE Transactions on Circuits and Systems-II: Express Briefs; vol. 65; No. 12; Dec. 2018; 5 pages.
Elad Alon, Jaeha Kim, Sudhakar Pamarti, Ken Chang and Mark Horowitz; "Replica Compensated Linear Regulators for Supply-Regulated Phase-Locked Loops"; White Paper; IEEE Journal of Solid-State Circuits; vol. 41; No. 2; Feb. 2006; 12 pages.

* cited by examiner

ADAPTABLE LOW DROPOUT (LDO) VOLTAGE REGULATOR AND METHOD THEREFOR

CROSS-REFERENCE TO RELATED APPLICATIONS

This application claims the benefit of U.S. Provisional Patent Application No. 63/052,309, filed on Jul. 15, 2020, the entire contents of which are incorporated herein by reference.

FIELD OF THE DISCLOSURE

This disclosure relates generally to power converters, and more specifically to low dropout (LDO) voltage regulators and related circuits.

BACKGROUND

Certain circuits, such as high-performance voltage-controlled oscillators (VCOs), require a dedicated low-noise power supply. A high-performance VCO's power supply is typically implemented as a linear regulator, and more specifically as a low dropout (LDO) regulator. A low dropout (LDO) linear regulator generally includes a pass device and an error amplifier that measures the deviation of the output voltage from a reference voltage, and raises or lowers the conductivity of the pass device to regulate output voltage.

A VCO and its power supply are closely co-designed to prevent noise from the power supply from causing frequency error of the VCO, and existing VCO regulator designs have been re-designed over time to achieve these more stringent standards. One example of a new design that lowers noise is an open-loop LDO regulator that uses a replica loop to create the gate drive voltage for the output pass device. Because the feedback signal is developed from the replica loop and not from the noisy VCO supply, the open-loop VCO is effective to reduce noise caused by the load. However, emerging standards for VCOs, such as IEEE 802.11 ("Wi-Fi") standards, have required continuously lower PLL phase-noise using a lower loop integration bandwidth starting frequency, making it difficult to extend the capabilities of known LDO architectures. Since additional incremental modifications to existing architectures provide diminishing returns, new topologies and features are required to reduce noise at lower cost.

BRIEF DESCRIPTION OF THE DRAWINGS

The present disclosure may be better understood, and its numerous features and advantages made apparent to those skilled in the art by referencing the accompanying drawings, in which.

The use of the same reference symbols in different drawings indicates similar or identical items. Unless otherwise noted, the word "coupled" and its associated verb forms include both direct connection and indirect electrical connection by means known in the art, and unless otherwise noted any description of direct connection implies alternate embodiments using suitable forms of indirect electrical connection as well.

DETAILED DESCRIPTION

Figure 1:
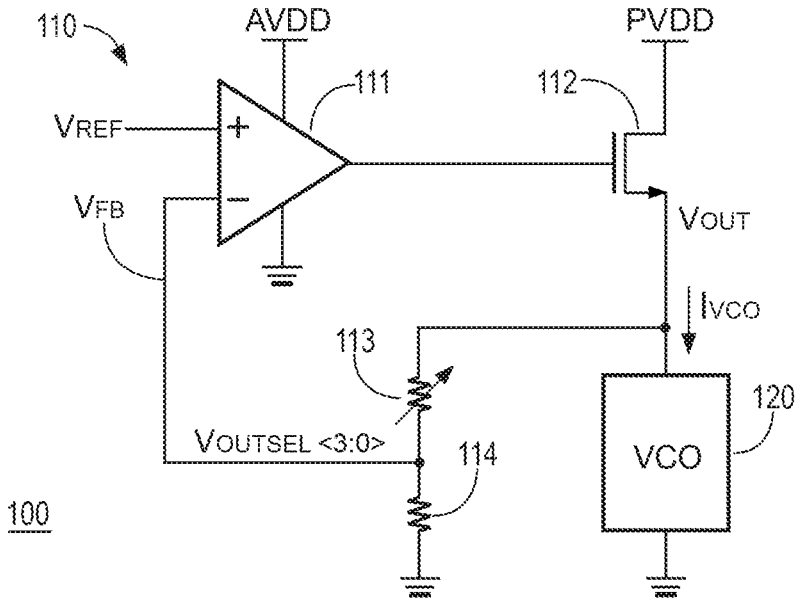
FIG. 1 (Prior Art)
FIG. 1 illustrates in partial block diagram and partial schematic form a voltage-controlled oscillator (VCO) circuit powered by a low dropout (LDO) voltage regulator known in the prior art.

FIG. 1 illustrates in partial block diagram and partial schematic form a voltage-controlled oscillator (VCO) circuit 100 powered by a conventional low dropout (LDO) regulator 110 known in the prior art. VCO circuit 100 includes an LDO regulator 110 and a VCO 120. LDO regulator 110 includes an error amplifier 111, a transistor 112, a variable resistor 113, and a resistor 114. Error amplifier 111 has a non-inverting input for receiving a reference voltage labelled "$V_{REF}$", an inverting input for receiving a feedback voltage labelled "$V_{FB}$", a positive power supply terminal for receiving an analog power supply voltage labelled "AVDD", a negative power supply terminal connected to ground, and an output. Transistor 112 is an N-channel metal-oxide-semiconductor (MOS) transistor having a drain for receiving a power supply voltage labelled "PVDD", a gate connected to the output of error amplifier 111, and a source for providing an output voltage of LDO regulator 110 labelled "$V_{OUT}$". Resistor 113 has a first terminal connected to the source of transistor 112, a second terminal connected to the inverting input of error amplifier 111 for providing the VFB signal thereto, and a control terminal for receiving a control signal labelled "$V_{OUTSEL}$<3:0>".

VCO 120 has a positive power supply terminal connected to the drain of transistor 112, a negative power supply terminal connected to ground, and other inputs and/or outputs not shown in FIG. 1. VCO 120 is powered by a power supply voltage formed by $V_{OUT}$ with respect to ground, and conducts a power supply current labelled "$I_{VCO}$" supplied by LDO regulator 110.

In operation, LDO regulator 110 provides a regulated output voltage $V_{OUT}$ to VCO 120 at an instantaneous current equal to $I_{VCO}$. Variable resistor 113 and resistor 114 together form a voltage divider that allows a user to set the value of $V_{FB}$ to equal $V_{REF}$ when $V_{OUT}$ is equal to the desired voltage. To make $V_{OUT}$ programmable so that LDO regulator 110 can operate with different circuits, variable resistor 113 is itself programmable using control signal $V_{OUTSEL}$<3:0>. Because VCO 120 is large circuit and $I_{VCO}$ is a relatively large current, transistor 112 is implemented as a large N-channel transistor with a large gate capacitance. The large gate capacitance ensures loop stability, but lowers the loop bandwidth. Thus, sudden changes in $I_{VCO}$ caused by changes in the load due to, e.g., simultaneous switching events, can cause ripple in $V_{OUT}$ and undesirable frequency jitter in the clock signal output by VCO 120.

Figure 2:
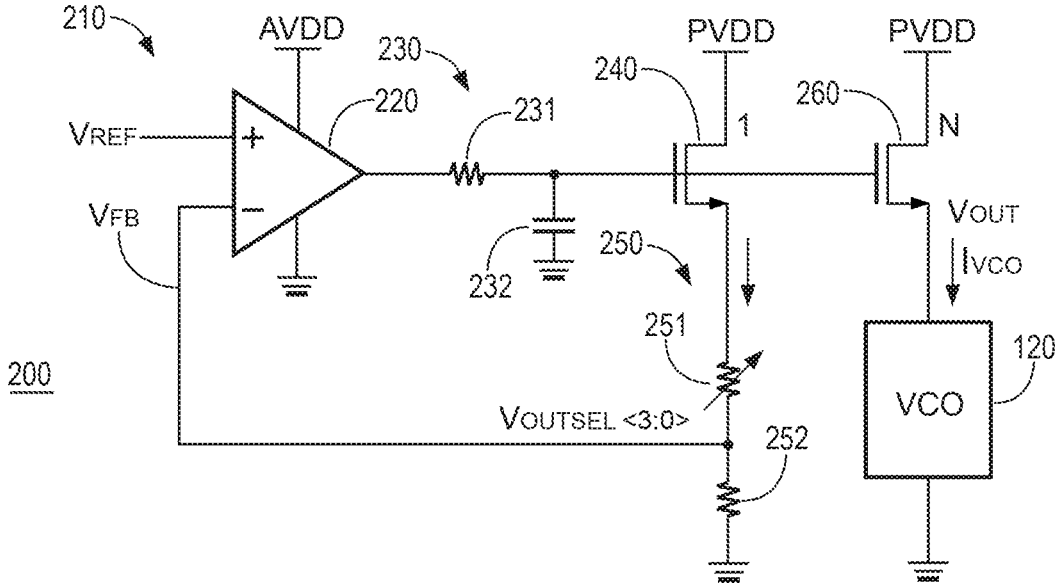
FIG. 2 (Prior Art)
FIG. 2 illustrates in partial block diagram and partial schematic form another VCO circuit having the VCO of FIG. 1 powered by another LDO regulator known in the prior art.

FIG. 2 illustrates in partial block diagram and partial schematic form another VCO circuit 200 having VCO 120 of FIG. 1 powered by another LDO regulator 210 known in the prior art. LDO regulator 210 includes an error amplifier 220, a lowpass filter 230, a transistor 240, a voltage divider 250, and a transistor 260. Error amplifier 220 has a non-inverting input for receiving reference voltage $V_{REF}$, an inverting input for receiving feedback voltage $V_{FB}$, a positive power supply terminal for receiving AVDD, a negative power supply terminal connected to ground, and an output.

Lowpass filter 230 includes a resistor 231, and a capacitor 232. Resistor 221 has a first terminal connected to the output of error amplifier 220, and a second terminal. Capacitor 232 has a first terminal connected to the second terminal of resistor 221, and a second terminal connected to ground.

Transistor 240 is an N-channel MOS transistor used as an LDO pass transistor and having a drain for receiving power supply voltage PVDD, a gate connected to the second terminal of resistor 231, and a source. As will be explained further below, transistor 240 has a relative size of 1.

Voltage divider 250 includes a variable resistor 251, and a resistor 252. Variable resistor 251 has a first terminal connected to the source of transistor 240, a second terminal connected to the inverting input of error amplifier 220 for providing the $V_{FB}$ signal thereto, and a control terminal for receiving the $V_{OUTSEL}$<3:0> signal. Resistor 252 has a first terminal connected to the second terminal of variable resistor 251, and a second terminal connected to ground.

Transistor 260 is an N-channel MOS transistor used as an LDO pass transistor and having a drain for receiving power supply voltage PVDD, a gate connected to the second terminal of resistor 231, and a source connected to the positive power supply terminal of VCO 120 for providing $V_{OUT}$ and sourcing current $I_{OUT}$ thereto. As will be explained further below, transistor 240 has a relative size of N.

In operation, LDO regulator 210 operates similarly to LDO regulator 110 of FIG. 1, except that LDO regulator 210 uses a replica feedback loop to regulate the gate voltage provided to both transistor 240 (in the replica feedback loop) and transistor 260 (in the output path). The replica loop forms the $V_{FB}$ that sets $V_{OUT}$, short variations in $I_{OUT}$ caused by changes in the load do not directly affect the replica loop do not cause error amplifier 220 to change the conductivity of transistor 260, thus helping to reduce power supply noise and therefore VCO clock jitter. Lowpass filter 230 improves loop stability but limits loop bandwidth. While improving the performance of LDO regulator 110 of FIG. 1, it would be desirable to develop new architectures to further reduce noise and the cost of the LDO regulator.

Figure 3:
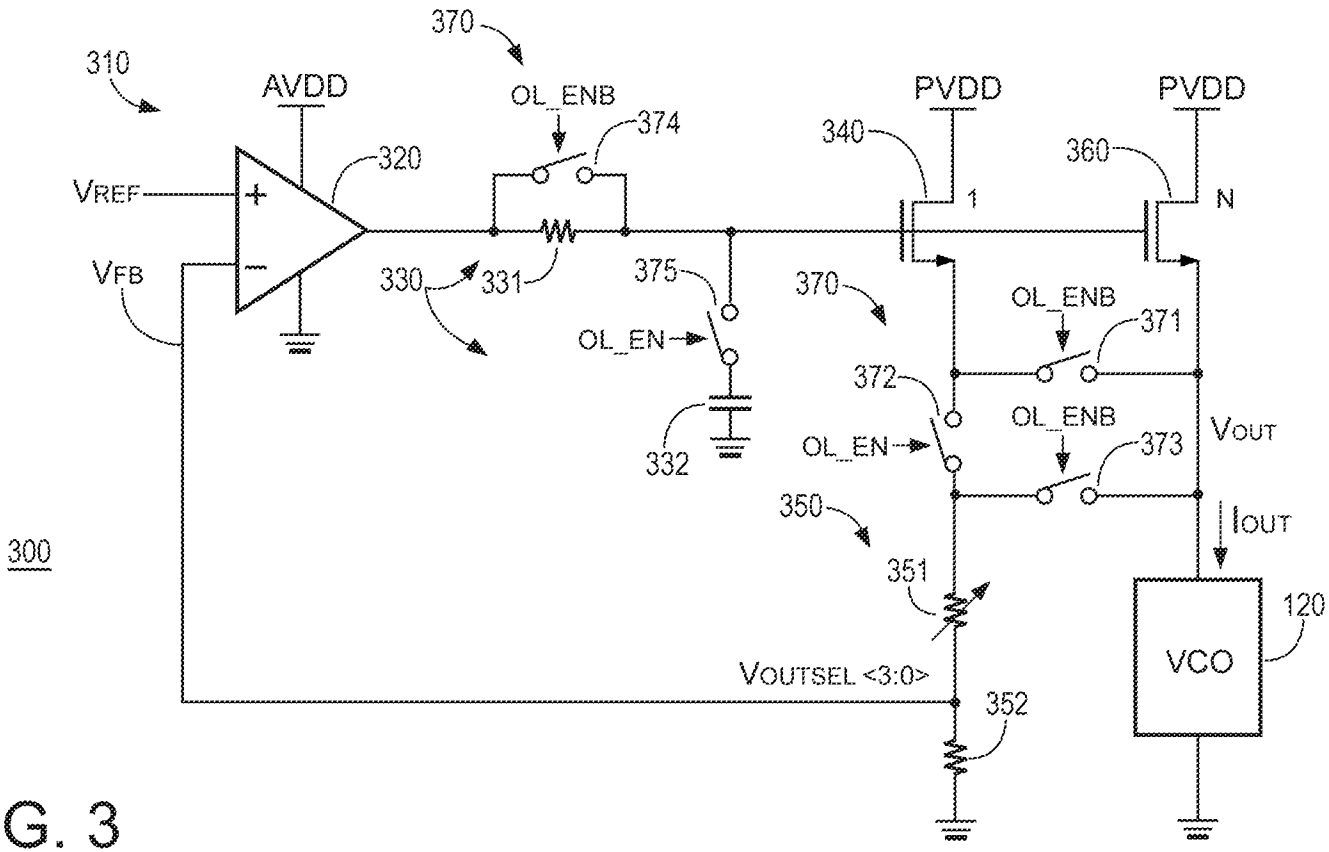
FIG. 3 illustrates in partial block diagram and partial schematic form a VCO circuit having the VCO of FIG. 1 powered by an adaptable LDO voltage regulator according to an embodiment of the present disclosure.

FIG. 3 illustrates in partial block diagram and partial schematic form a VCO circuit 300 having VCO 120 of FIG. 1 powered by an adaptable LDO regulator 310 according to an embodiment of the present disclosure. Adaptable LDO regulator 310 includes an error amplifier 320, a lowpass filter 330, a transistor 340, a voltage divider 350, a transistor 360, and a mode selection network 370.

Error amplifier 320 has a non-inverting input for receiving reference voltage $V_{REF}$, an inverting input for receiving feedback voltage $V_{FB}$, a positive power supply terminal for receiving AVDD, a negative power supply terminal connected to ground, and an output.

Lowpass filter 330 includes a resistor 331 and a capacitor 332. Resistor 331 has a first terminal connected to the output of error amplifier 320, and a second terminal. Capacitor 332 has a first terminal, and a second terminal connected to ground.

Transistor 340 is an N-channel MOS transistor used as a first LDO pass transistor and having a drain for receiving power supply voltage PVDD, a gate connected to the second terminal of resistor 331, and a source. As will be explained further below, transistor 340 has a relative size of 1.

Voltage divider 350 includes a variable resistor 351, and a resistor 352. Variable resistor 351 has a first terminal connected to the source of transistor 240, a second terminal connected to the inverting input of error amplifier 320 for providing the $V_{FB}$ signal thereto, and a control terminal for receiving the $V_{OUTSEL}$<3:0> signal. Resistor 352 has a first terminal connected to the second terminal of variable resistor 351, and a second terminal connected to ground.

Transistor 360 is an N-channel MOS transistor used as a second LDO pass transistor and having a drain for receiving power supply voltage PVDD, a gate connected to the second terminal of resistor 331, and a source connected to the positive power supply terminal of VCO 120 for providing $V_{OUT}$ and sourcing current $I_{OUT}$ thereto. As will be explained further below, transistor 340 has a relative size of N.

Mode selection network 370 includes switches 371-375. Switch 371 has a first terminal connected to the source of transistor 340, a second terminal connected to the source of transistor 360, and a control terminal for receiving a signal labelled "OL_ENB", and is closed in response to the activation of signal OL_ENB, but is open otherwise. Switch 372 has a first terminal connected to the source of transistor 340, a second terminal connected to the first terminal of variable resistor 351, and a control terminal for receiving a signal labelled "OL_EN", and is closed in response to the activation of signal OL_EN, but is open otherwise. Switch 373 has a first terminal connected to the second terminal of switch 372, a second terminal connected to the source of transistor 360, and a control terminal for receiving signal OL_ENB, and is closed in response to the activation of signal OL_ENB, but is open otherwise. Switch 374 has a first terminal connected to the first terminal of resistor 331, a second terminal connected to the second terminal of resistor 331, and a control terminal for receiving signal OL_ENB, and is closed in response to the activation of signal OL_ENB, but is open otherwise. Switch 375 has a first terminal connected to the second terminal of resistor 331, a second terminal connected to the first terminal of capacitor 332, and a control terminal for receiving signal OL_EN, and is closed in response to the activation of signal OL_EN, but is open otherwise.

In operation, adaptable LDO regulator 310 is a low-noise, low-cost regulator suitable for powering a VCO or other similar circuit. It is flexible, software-configurable, and able to handle the needs of various VCO architectures and performances without the need for custom designs. Thus, it provides substantial design re-use opportunities.

In an open loop mode, signal OL_EN is active at a logic high, and signal OL_ENB is inactive at a logic low. Switch 374 is open and switch 375 is closed, enabling lowpass filter 330 to filter the output of error amplifier 320. Switch 372 is closed, closing the replica loop feedback path. Switches 371 and 373 are open, isolating the output path from the replica feedback path.

In a closed loop mode, signal OL_EN is inactive at a logic low, and signal OL_ENB is active at a logic high. Switch 374 is closed, bypassing resistor 331, and switch 375 is open, isolating capacitor 332, thus disabling lowpass filter 330 from filtering the output of error amplifier 320. Switch 372 is open, opening the replica loop feedback path, but switches 371 and 373 are closed, connecting the output path to the feedback path.

In one embodiment, LDO regulator 310 also provides a fast charging mode. In the fast charging mode, switch 374 is controlled by a control signal that is active when either closed loop mode is selected (OL_ENB=1) or when open loop mode is selected and LDO regulator 310 is transitioning from an off state to an on state. Switch 374 is closed, bypassing resistor 331, but switch 375 is also closed, connecting capacitor 332 to the output of error amplifier 320. Bypassing resistor 331 temporarily allows capacitor 332 to charge quickly, shortening startup time and allowing $V_{OUT}$ to ramp up to its desired value faster.

Figure 4:
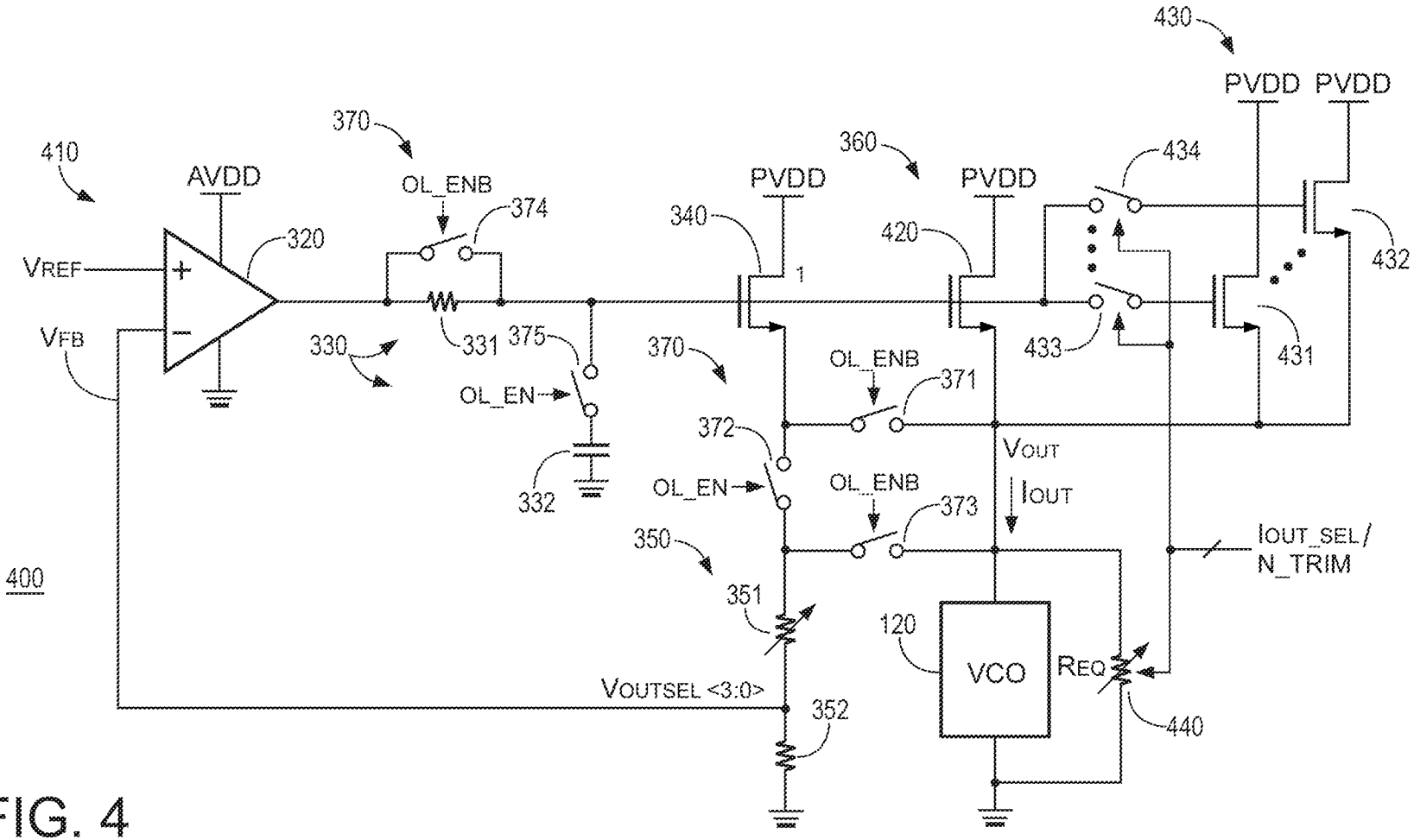
FIG. 4 illustrates in partial block diagram and partial schematic form a VCO circuit having the VCO of FIG. 1 powered by an adaptable LDO regulator according to an embodiment of the present disclosure.

FIG. 4 illustrates in partial block diagram and partial schematic form a VCO circuit 400 having VCO 120 of FIG. 1 powered by an adaptable LDO regulator 410 according to an embodiment of the present disclosure. Adaptable LDO regulator 410 is similar to adaptable LDO regulator 310 of FIG. 3, except that it implements transistor 360 as a segmented pass device using a base transistor 420 and a set of selectable transistors 430, and modifies mode selection network 370 to include a selectable resistor 450 that allows VCO 120 to be implemented as a current mode VCO.

Base transistor 420 is an N-channel MOS transistor having a drain for receiving PVDD, a gate connected to the second terminal of resistor 331 and to the second terminal of switch 374, and a source for providing $V_{OUT}$. Selectable transistors 430 include a number of transistors including representative transistors 431 and 432 and representative switches 433 and 434. Transistor 431 in an N-channel MOS transistor having a drain for receiving PVDD, a gate, and a source connected to the source of base transistor 420. Transistor 432 in an N-channel MOS transistor having a drain for receiving PVDD, a gate, and a source connected to the source of base transistor 420. Switch 433 has a first terminal connected to the second terminal of resistor 331 and to the second terminal of switch 374, a second terminal connected to the gate of transistor 431, and a control terminal for receiving a corresponding bit of either a multi-bit signal labelled "N_TRIM" when a voltage mode is selected, or a multi-bit signal labelled "$I_{OUT}$_SEL" when a current mode is selected. Switch 434 has a first terminal connected to the second terminal of resistor 331 and to the second terminal of switch 374, a second terminal connected to the gate of transistor 434, and a control terminal for receiving a corresponding bit of either N_TRIM or $I_{OUT}$_SEL, depending on the selected mode.

Selectable resistor 450 has a first terminal connected to the source of base transistor 420, a second terminal connected to ground, and a control terminal for receiving a corresponding bit of $I_{OUT}$_SEL. When in current mode, selectable resistor 450 has a variable resistance labeled "$R_{EQ}$" whose value is set by $I_{OUT}$_SEL. When in voltage mode, selectable resistor 450 is not used.

Adaptable LDO regulator 410 provides operating power to a circuit such as VCO 120 in either in a voltage more or a current mode. In voltage mode, the N_TRIM signal trims the output impedance by enabling or disabling various ones of selectable transistors 430, while selectable resistor 450 is not used. In current mode, the $I_{OUT}$_SEL signal enables or disables various ones of selectable transistors 430 and correspondingly changes REQ through selectable resistor 450 to set the output current.

Adaptable LDO regulator 410 provides greater flexibility than LDO regulator 310 of FIG. 3 through two programmable enhancements. First, it provides the ability to trim transistor 360. Generally, the ratio of transistor 340 to transistor 360 is 1:N, with N being an integer greater than 1, although N can be any value greater than 1. In other embodiments, N can be any whole or fractional number greater than 1. Second, it provides the ability to operate with either a voltage mode VCO or a current mode VCO. Either or both of these programmable enhancements can be used in conjunction with or separately from the open-loop/closed loop mode selection of adaptable LDO regulator 310 of FIG. 3.

Figure 5:
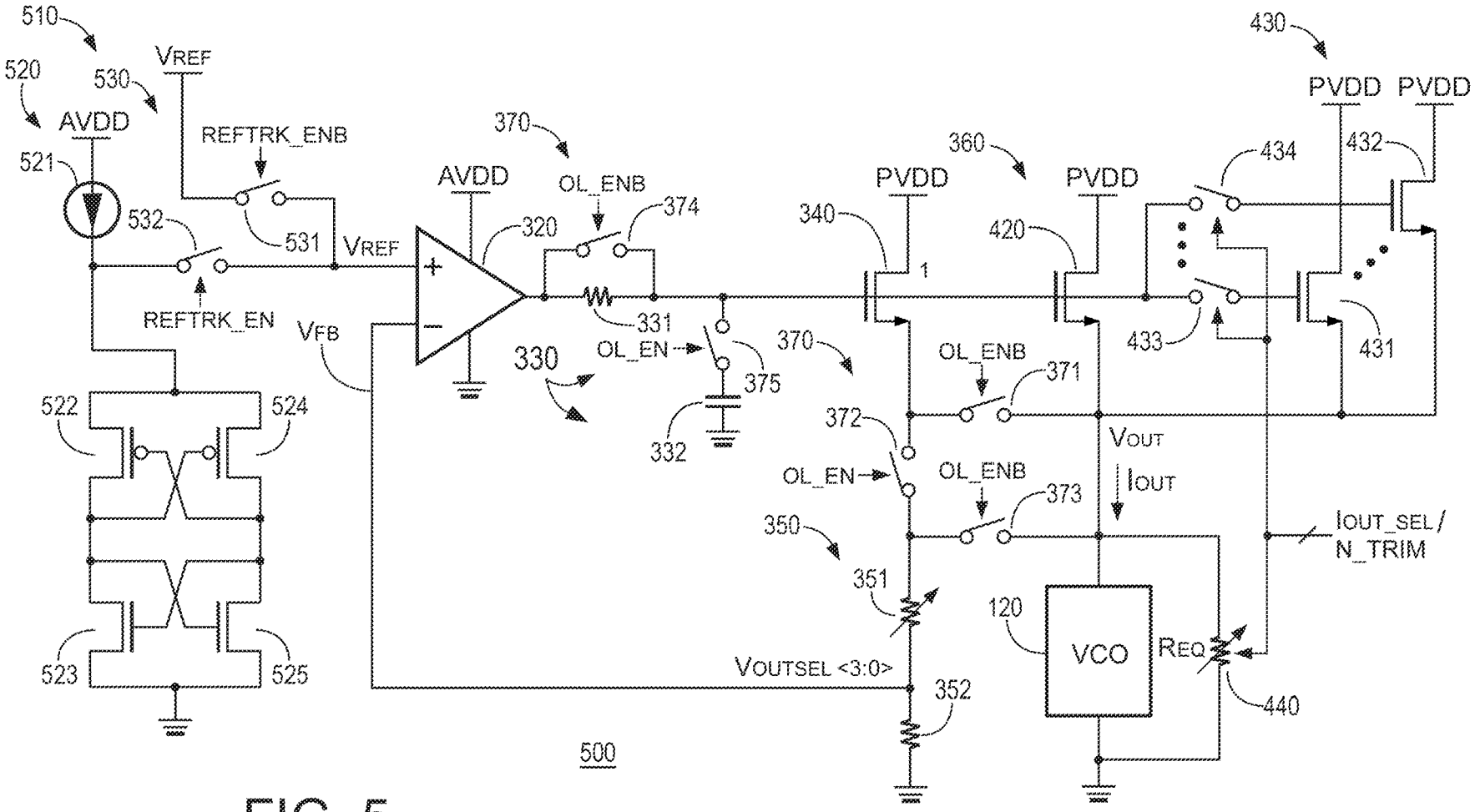
FIG. 5 illustrates in partial block diagram and partial schematic form a VCO circuit having the VCO of FIG. 1 powered by an adaptable LDO regulator according to yet another embodiment of the present disclosure.

FIG. 5 illustrates in partial block diagram and partial schematic form a VCO circuit 500 having VCO 120 of FIG. 1 powered by an adaptable LDO regulator 510 according to yet another embodiment of the present disclosure. Adaptable LDO voltage regulator 510 is similar to adaptable LDO regulator 310 of FIG. 3 and 410 of FIG. 4, except that it adds a feature known as "$V_{REF}$ tracking" using a selectable $V_{REF}$ tracking circuit 520. Selectable $V_{REF}$ tracking circuit 520 includes a current source 521, transistors 522-525, and a switch network 530. Current source 521 has a first terminal for receiving AVDD, and a second terminal. Transistor 522 is a P-channel MOS transistor having a source connected to the second terminal of current source 521, a gate, and a drain. Transistor 523 is an N-channel MOS transistor having a drain connected to the drain of transistor 522, a gate, and a source connected to ground. Transistor 524 is a P-channel MOS transistor having a source connected to the second terminal of current source 521, a gate connected to the drain of transistor 512, and a drain connected to the gates of transistors 522 and 523. Transistor 525 is an N-channel MOS transistor having a drain connected to the drain of transistor 524, a gate connected to the drains of transistors 522 and 523, and a source connected to ground.

In switch network 530, switch 531 has a first terminal for receiving $V_{REF}$, a second terminal connected to the non-inverting input of error amplifier 320, and a control terminal for receiving a signal labelled "REFTRAK_ENB", and is closed in response to the activation of signal REFTRAK_ENB, but is open otherwise. Switch 532 has a first terminal connected to the second terminal of current source 521, a second terminal connected to the second terminal of switch 531 and to the non-inverting input of error amplifier 320, and a control terminal for receiving a signal labelled "REFTRAK_EN", and is closed in response to the activation of signal REFTRAK_EN, but is open otherwise.

$V_{REF}$ tracking mode is a feature available for use in open loop mode (OL_EN=1). When $V_{REF}$ tracking is not selected, REFTRK_EN=0 and REFTRK_ENB=1, causing switch 531 to be closed and switch 532 to be open. In this mode, $V_{REF}$ is provided to the non-inverting input of error amplifier 320 from a fixed voltage source (not shown in FIG. 5), that may not necessarily track the operation of circuitry in adaptable LDO voltage regulator 510 when power supply voltage and temperature change.

When $V_{REF}$ tracking is selected, REFTRK_EN=1 and REFTRK_ENB=0, causing switch 531 to be open and switch 532 to be closed. In this mode, $V_{REF}$ is provided to the non-inverting input of error amplifier 320 as a voltage that varies as the N- and P-channel threshold voltages vary. Transistors 522 and 524 are P-channel MOS transistors sized to march the sizes of P-channel transistors used in VCO 120. Likewise, transistors 522 and 524 are N-channel MOS transistors sized to march the sizes of transistors used in VCO 120. Thus, variations in transistors 522-524 track and cancel those of corresponding transistors in VCO 120.

Current source 521 provides a substantially constant current. The $V_{REF}$ voltage generated at the second terminal of current source 521 is that voltage in which the sum of the current through transistors 522 and 523 plus the current through transistors 524 and 525 is equal to the substantially constant current of current source 521. This voltage will vary as manufacturing process and temperature varies, but in a way that tracks the conductivities of the load transistors in VCO 120.

Figure 6:
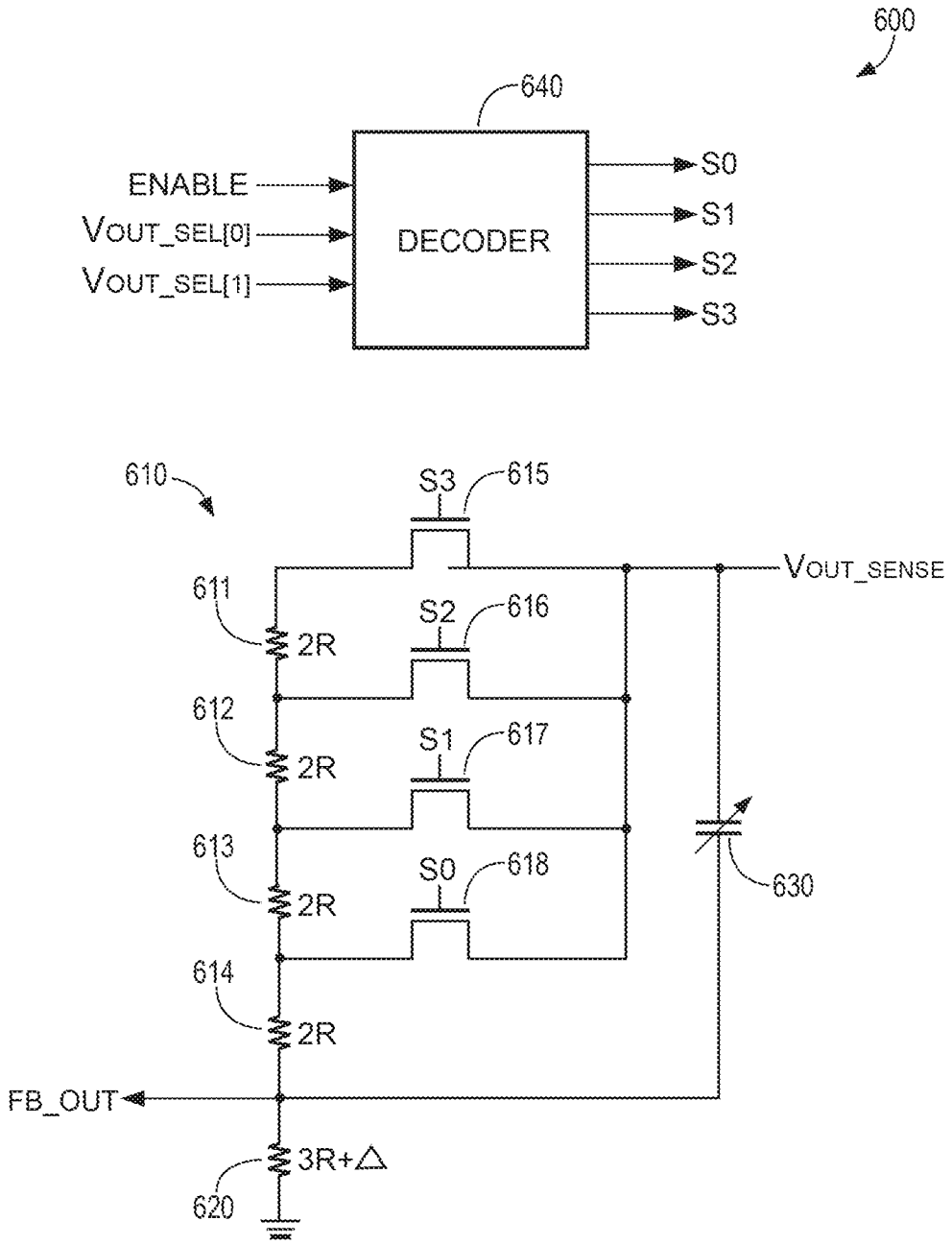
FIG. 6 (Prior Art)
FIG. 6 illustrates in partial block diagram and partial schematic form a voltage divider known in the prior art.

FIG. 6 illustrates in partial block diagram and partial schematic form a voltage divider 600 known in the prior art. Voltage divider 600 includes generally a variable resistor 610, a fixed resistor 620, a variable capacitor 630, and a decoder 640.

Variable resistor 610 includes resistors 611-614 and transistors 615-618. Resistor 611 has a first terminal, and a second terminal. Resistor 612 has a first terminal connected to the second terminal of resistor 611, and a second terminal. Resistor 613 has a first terminal connected to the second terminal of resistor 612, and a second terminal. Resistor 614 has a first terminal connected to the second terminal of resistor 613, and a second terminal for providing a signal labelled "FB_OUT". Each of resistors 611-614 has a size equal to 2R, in which "R" is a unit value. Transistor 615 has a first current electrode connected to the first terminal of resistor 611, a control electrode for receiving a signal labelled "S3", and a second terminal. Transistor 616 has a first current electrode connected to the first terminal of resistor 612, a control electrode for receiving a signal labelled "S2", and a second terminal connected to the second current electrode of transistor 615. Transistor 617 has a first current electrode connected to the first terminal of resistor 613, a control electrode for receiving a signal labelled "S1", and a second terminal connected to the second current electrode of transistors 615 and 616. Transistor 618 has a first current electrode connected to the first terminal of resistor 614, a control electrode for receiving a signal labelled "S0", and a second terminal connected to the second current electrodes of transistors 615-617.

Fixed resistor 620 has a first terminal connected to the second terminal of resistor 614, and a second terminal connected to ground. Resistor 620 has a resistance equal to 3R+Δ, in which Δ is a relatively small value.

Variable capacitor 630 has a first terminal connected to the second current electrode of transistors 615-618, a second terminal connected to the second terminal of resistor 614 and the first terminal of fixed resistor 620, and a control terminal for receiving a trim signal.

Decoder 640 has a first input for receiving a signal labelled "ENABLE", a second input for receiving the least-significant bit of the $V_{OUT_SEL}$ signal labelled "$V_{OUT_SEL}$[0]", a third input for receiving the most-significant bit of $V_{OUT_SEL}$ labelled "$V_{OUT_SEL}$[1]", and outputs for providing the S0, S1, S2, and S3 signals.

Variable resistor 610 includes four switches that programmably bypass corresponding ones of resistors 611-614. Decoder 640 is a one-hot decoder, and when the ENABLE signal is active, decoder 640 activates one of S0, S1, S2, and S3 based on the states of $V_{OUT_SEL}$[0] and $V_{OUT_SEL}$[1]. For example, when S2 is active, variable resistor 610 has a resistance equal to 3×2R=6R. Thus, FB_OUT is approximately equal to but slightly more than ⅓×$V_{OUT}$_SENSE due to the Δ. Variable resistor 610 also includes variable capacitor 630 to provide enhanced stability of the feedback loop.

Figure 7:
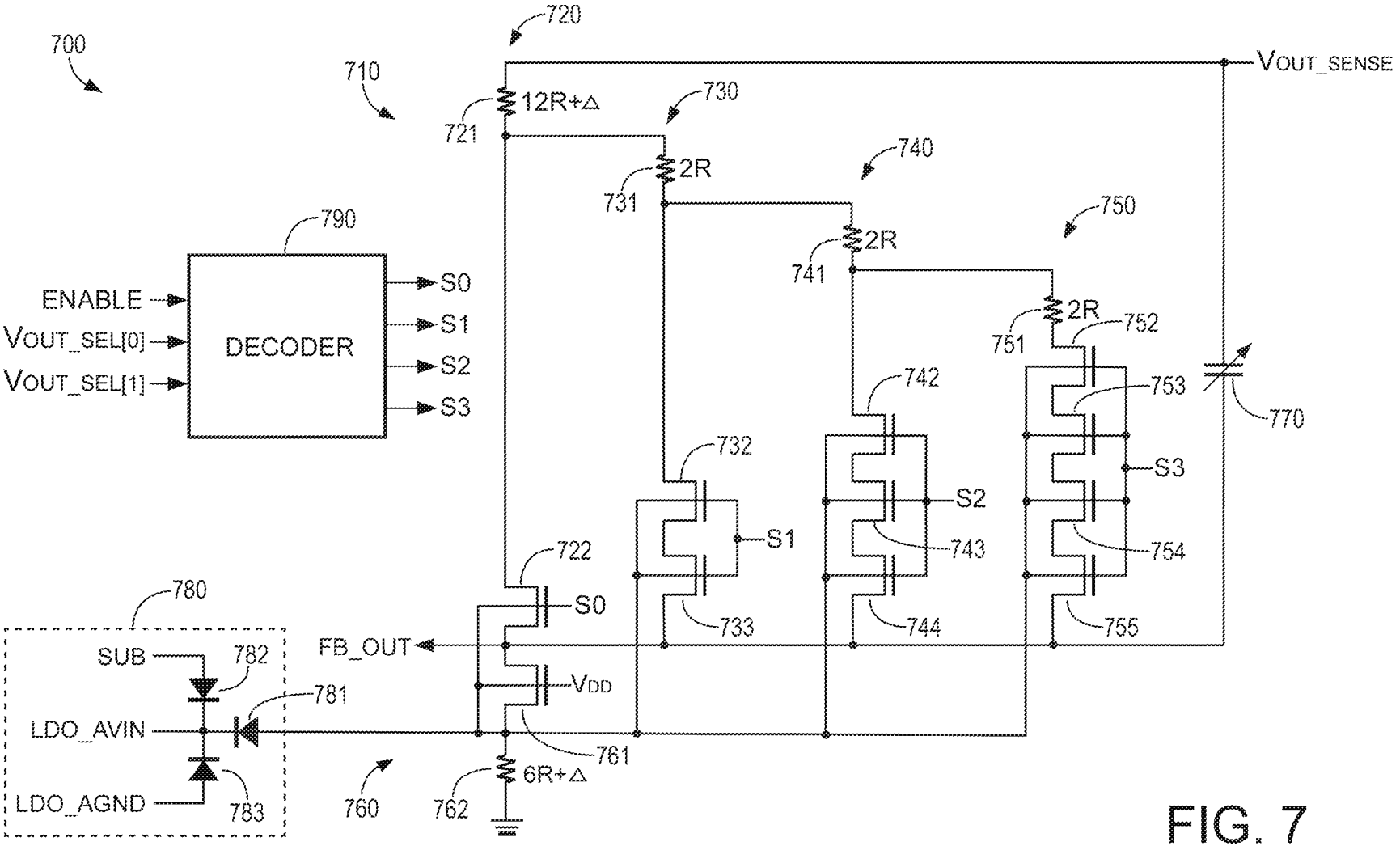
FIG. 7 illustrates in partial block diagram and partial schematic form a voltage divider suitable for use in the LDO regulators of FIGS. 3-5 according to an embodiment of the present disclosure.

FIG. 7 illustrates in partial block diagram and partial schematic form a voltage divider 700 suitable for use in the LDO regulators of FIGS. 3-5 according to an embodiment of the present disclosure. Voltage divider 700 includes generally a variable resistor 710, a fixed resistor 760, a variable capacitor 770, an isolation circuit 780, and a decoder 790.

Variable resistor 710 includes a first fixed resistor 712, a first branch 720, a second branch 730, a third branch 740, and a fourth branch 750. First fixed resistor 712 has a first terminal for receiving signal $V_{OUT}$_SENSE, and a second terminal. First branch 720 includes a first switch formed by a transistor 722. Transistor 722 is an N-channel MOS transistor having a drain connected to the second terminal of first fixed resistor 712, a gate for receiving signal S0, a source connected to a common node that provides signal FB_OUT, and a bulk terminal for receiving the bulk bias voltage.

Second branch 730 includes a second fixed resistor 731, and a second switch formed by transistors 732 and 734. Second fixed resistor 731 has a first terminal connected to the second terminal of first fixed resistor 712, and a second terminal. Transistor 732 is an N-channel MOS transistor having a drain connected to the second terminal of second fixed resistor 731, a gate for receiving signal S1, a source, and a bulk terminal for receiving the bulk bias voltage. Transistor 733 is an N-channel MOS transistor having a drain connected to the source of transistor 732, a gate for receiving signal S1, a source connected to the source of transistor 722, and a bulk terminal for receiving the bulk bias voltage.

Third branch 740 includes a third fixed resistor 741, and a third switch formed by transistors 742, 743, and 744. Third fixed resistor 741 has a first terminal connected to the second terminal of second fixed resistor 731, and a second terminal. Transistor 742 is an N-channel MOS transistor having a drain connected to the second terminal of third fixed resistor 741, a gate for receiving signal S2, a source, and a bulk terminal for receiving the bulk bias voltage. Transistor 743 is an N-channel MOS transistor having a drain connected to the source of transistor 742, a gate for receiving signal S2, a source, and a bulk terminal for receiving the bulk bias voltage. Transistor 744 is an N-channel MOS transistor having a drain connected to the source of transistor 743, a gate for receiving signal S2, a source connected to the sources of transistors 722 and 733, and a bulk terminal for receiving the bulk bias voltage.

Fourth branch 750 includes a fourth fixed resistor 751, and a fourth switch formed by transistors 752, 753, 754, and 755. Fourth fixed resistor 751 has a first terminal connected to the second terminal of third fixed resistor 741, and a second terminal. Transistor 752 is an N-channel MOS transistor having a drain connected to the second terminal of fourth fixed resistor 751, a gate for receiving signal S3, a source, and a bulk terminal for receiving the bulk bias voltage. Transistor 753 is an N-channel MOS transistor having a drain connected to the source of transistor 752, a gate for receiving signal S3, a source, and a bulk terminal for receiving the bulk bias voltage. Transistor 754 is an N-channel MOS transistor having a drain connected to the source of transistor 753, a gate for receiving signal S3, a source, and a bulk terminal for receiving the bulk bias voltage. Transistor 755 is an N-channel MOS transistor having a drain connected to the source of transistor 754, a gate for receiving signal S3, a source connected to the sources of transistors 722, 733, and 744, and a bulk terminal for receiving the bulk bias voltage.

Fixed resistor 760 includes a transistor 761 and a resistor 762. Transistor 761 is an N-channel MOS transistor having a drain connected to the source of transistor 722, a gate for receiving power supply voltage $V_{DD}$, a source for receiving the bulk bias voltage, and bulk terminal for receiving the bulk bias voltage. Resistor 762 has a first terminal connected to the source of transistor 761, and a second terminal connected to ground.

Variable capacitor 770 has a first terminal connected to the first terminal of first fixed resistor 712, a second terminal, and a control terminal for receiving the trim signal Isolation circuit 780 includes a diode 781, a diode 782, and a diode 783. Diode 781 has an anode connected to the first terminal of resistor 762, and a second terminal connected to a node that receives a voltage labelled "LDA_AVIN". Diode 782 has an anode for receiving a voltage labeled "SUB", and a cathode connected to the cathode of diode 781. Diode 783 has an anode for receiving a voltage labeled "LDO_AGND", and a cathode connected to the cathodes of diodes 781 and 782. The diodes in isolation circuit 780 are not actual diodes but rather are parasitic diodes formed by the physical layout of voltage divider 700.

Decoder 790 has a first input for receiving a signal labelled "ENABLE", a second input for receiving the least-significant bit of the $V_{OUT_SEL}$ signal, $V_{OUT_SEL}[0]$", a third input for receiving the most-significant bit of $V_{OUT_SEL}$, $V_{OUT_SEL}[1]$, and outputs for providing the S0, S1, S2, and S3 signals.

As $V_{OUT}$ increases, the voltage divider becomes a larger contributor to thermal noise to the larger value of variable resistor 710. For example, in the IEEE 802.11ax standard, at lower frequencies (such as 25 kHz), the voltage divider becomes a bigger contributor to noise, and the LDO regulator becomes very sensitive to resistor flicker noise and also to switch sizing.

Voltage divider 700, however, reduces resistance as much as possible while maintaining a reasonable circuit area. Generally, lower resistance requires much larger resistor widths for low 1/f noise, and lower resistances result in higher current, which requires larger switch widths to reduce IR losses and VOUT offset. Voltage divider 700 places a dummy switch 761 in the fixed resistor 760 at the voltage divider mid-point. Moreover, the switches in variable resistor 710 are placed at the voltage divider mid-point instead of at the top of the resistive divider. The switches in first resistor 710 are also scaled to match switch 761.

In this way, the switch voltages cancel, allowing a substantial size reduction in the switch and resistor sizes. For example, the unit size R can be reduced by approximately one third, and the overall voltage divider area can be cut in half for the same $V_{OUT}$ offset as voltage divider 600 of FIG. 6. It is also possible to scale the area of resistive divider 700 by increasing resistor sizes without exponential increases in area. The bulk and source voltages of all switches in resistor 710 are at a common voltage and thus Vbs=0, in which Vbs if the bulk-to-source voltage.

Thus, various embodiments of an adaptable LDO regulator for use with circuits such as VCOs have been described. The adaptable LDO regulator is able to operate either in open loop mode by using a replica loop to regulate the gate voltage of the output pass transistor in series with the load, or in closed loop mode in which the output pass transistor is in the feedback loop. Embodiments of the adaptable LDO regulator also provide a trim function for the trimming the size of the output pass device. The trim function van be used in conjunction with a selectable resistor in parallel with the load to allow the adaptable LDO regulator to be used with current-mode VCOs. The adaptable LDO regulator also has a tracking mode in which the reference voltage used in the feedback error amplifier can track the conductivities of transistors used in the load circuit. In some embodiments, the voltage divider can be used with a resistor divider that provides low noise and low switch offset voltage for a given size using a dummy switch at the switch midpoint, and parallel resistance paths with the selection switched placed at the midpoint, The above-disclosed subject matter is to be considered illustrative, and not restrictive, and the appended claims are intended to cover all such modifications, enhancements, and other embodiments that fall within the scope of the claims. For example, the disclosed embodiments used N-channel pass devices, but in alternate embodiments P-channel pass devices could be used as well. Various ones of the adaptable modes can be used independently of the other modes. While in the disclosed embodiments the ratio of the size of the replica loop pass transistor to the size of the output pass transistor is 1:N, in which N is an integer greater than 1, in other embodiments N can be a non-integer number greater than one. Also while certain numbers of selectable transistors, voltage steps, resistor divider steps and the like were shown for illustrative purposes, in other embodiments, different numbers of selectable transistors, voltage steps, resistor divider steps can be provided.

Thus, to the maximum extent allowed by law, the scope of the present invention is to be determined by the broadest permissible interpretation of the following claims and their equivalents, and shall not be restricted or limited by the forgoing detailed description.

What is claimed is:

1. An adaptable low dropout (LDO) regulator comprising:

an error amplifier providing an error voltage according to a difference between a feedback voltage and a reference voltage;

first and second pass transistors each having a first current electrode for receiving an input voltage, a control electrode for receiving said error voltage, and a second current electrode, said second current electrode of said second pass transistor providing an output voltage;

a voltage divider generating said feedback voltage in response to a voltage on an input thereof; and a mode selection network that:

in a closed loop mode, directly and electrically couples said second current electrodes of said first and second pass transistors together and to said input of said voltage divider; and in an open loop mode, directly and electrically couples said second current electrode of said first pass transistor to said input of said voltage divider and decouples said second current electrodes of said first and second pass transistors.

2. The adaptable LDO regulator of claim 1, wherein a second gate width-to-gate length ratio of said second pass transistor is N times larger than a first gate width-to-gate length ratio of said first pass transistor, wherein N is an integer greater than one.

3. The adaptable LDO regulator of claim 1, wherein said second pass transistor comprises:

a base transistor having a first current electrode for receiving said input voltage, a control electrode for receiving said error voltage, and a second current electrode for providing said output voltage; and a plurality of selectable transistors each having a first current electrode for receiving said input voltage, a control electrode that selectively receiving said error voltage according to a corresponding select signal, and a second current electrode coupled to said second current electrode of said base transistor.

4. The adaptable LDO regulator of claim 3, further comprising:

a selectable resistance having a first terminal coupled to said second current electrode of said second pass transistor, a second terminal connected to said a ground voltage terminal, and a control terminal for receiving a select signal.

5. The adaptable LDO regulator of claim 1, further comprising:

a lowpass filter coupled between an output of said error amplifier and said control electrode of said first pass transistor and said control electrode of said second pass transistor, wherein:

in said closed loop mode, said mode selection network further disables said lowpass filter; and in said open loop mode, said mode selection network further enables said lowpass filter.

6. The adaptable LDO regulator of claim 5, wherein:

said lowpass filter comprises:

a resistor having a first terminal for receiving said error voltage, and a second terminal coupled to said control electrode of said first pass transistor and said control electrode of said second pass transistor; and a capacitor having a first terminal, and a second terminal coupled to ground, and said mode selection network comprises:

a first switch coupled between said first and second terminals of said resistor; and a second switch having a first terminal coupled to said second terminal of said resistor, and a second terminal coupled to said first terminal of said capacitor, wherein in a fast charging mode, the adaptable LDO regulator opens said first switch and closes said second switch.

7. The adaptable LDO regulator of claim 1, wherein said voltage divider comprises:

a first resistor having a first terminal coupled to said second current electrode of said first pass transistor, a second terminal coupled to a feedback terminal for providing said feedback voltage, and a control terminal for receiving a voltage select signal, wherein said first resistor is a variable resistor and said voltage select signal selects a resistance of said first resistor; and a second resistor having a first terminal coupled to said second terminal of said first resistor, and a second terminal coupled to a ground voltage terminal.

8. The adaptable LDO regulator of claim 7, further comprising a capacitor having a first terminal coupled to said first terminal of said first resistor, and a second terminal coupled to said second terminal of said first resistor.

9. The adaptable LDO regulator of claim 7, wherein said first terminal of said second resistor is coupled to said second terminal of said first resistor through a dummy switch, wherein said dummy switch has a first current electrode coupled to said second terminal of said first resistor, a second current electrode coupled to said first terminal of said second resistor, and a control electrode biased to a voltage that makes said dummy switch conductive.

10. The adaptable LDO regulator of claim 7, wherein said first resistor comprises:

a first fixed resistor having a first terminal forming said input of said voltage divider, and a second terminal;

a first branch having a first switch coupled between said second terminal of said first fixed resistor and said feedback terminal;

a second branch having a second fixed resistor with a first terminal coupled to said second terminal of said first fixed resistor, and a second terminal, and a second switch coupled between said second terminal of said second fixed resistor and said feedback terminal; and a third branch having a third fixed resistor with a first terminal coupled to said second terminal of said second fixed resistor, and a second terminal, and a third switch coupled between said second terminal of said third fixed resistor and said feedback terminal.

11. The adaptable LDO regulator of claim 10, wherein said first resistor further comprises:

a fourth branch having a fourth fixed resistor with a first terminal coupled to said second terminal of said third fixed resistor, and a second terminal, and a fourth switch coupled between said second terminal of said fourth fixed resistor and said feedback terminal.

12. The adaptable LDO regulator of claim 10, wherein a resistance of said third fixed resistor is substantially equal to a resistance of said second fixed resistor.

13. The adaptable LDO regulator of claim 10, wherein said first switch comprises one unit switch, said second switch comprises two unit switches, and said third switch comprises three unit switches.

14. The adaptable LDO regulator of claim 13, wherein said first terminal of said second resistor is coupled to said second terminal of said first resistor through a dummy switch, and wherein each unit switch in said first switch, said second switch, and said third switch has a bulk terminal coupled to said first terminal of said second resistor.

15. The adaptable LDO regulator of claim 1, further comprising:

a reference voltage tracking circuit coupled to said error amplifier that in a tracking mode sets said reference voltage dynamically according to a sum of a P-channel transistor threshold plus an N-channel transistor threshold, and in a normal operation mode sets said reference voltage statically to a predetermined voltage.

16. An adaptable low dropout (LDO) regulator for use with a low-noise voltage controlled oscillator or the like, the adaptable LDO regulator comprising:

an error amplifier having a non-inverting input for receiving a reference voltage, an inverting input for receiving a feedback voltage from a feedback terminal, and an output;

a lowpass filter having an input coupled to said output of said error amplifier, and an output;

a first pass transistor having a first current electrode for receiving an input voltage, a control electrode coupled to said output of said lowpass filter, and a second current electrode;

a voltage divider having a first terminal, and a second terminal coupled to a voltage reference terminal, and an intermediate terminal for providing said feedback voltage; and a second pass transistor having a first current electrode for receiving said input voltage, a control electrode coupled to said output of said lowpass filter, and a second current electrode for providing an output voltage; and a mode selection network that:

in a closed loop mode, directly and electrically couples said second current electrode of said first pass transistor to said second current electrode of said second pass transistor and to said input of said voltage divider, and in an open loop mode, directly and electrically couples said second current electrode of said first pass transistor to said input of said voltage divider and decouples said second current electrode of said second pass transistor from said second current electrode of said first pass transistor and said first terminal of said voltage divider.

17. The adaptable LDO regulator of claim 16, wherein a second gate width-to-gate length ratio of said second pass transistor is N times larger than a first gate width-to-gate length ratio of said first pass transistor, wherein N is an integer greater than one.

18. The adaptable LDO regulator of claim 16, further comprising:

a lowpass filter coupled between an output of said error amplifier and said control electrode of said first pass transistor and said control electrode of said second pass transistor, wherein:

in said closed loop mode, said mode selection network further disables said lowpass filter; and in said open loop mode, said mode selection network further enables said lowpass filter.

19. The adaptable LDO regulator of claim 18, wherein said voltage divider comprises:

a first resistor having a first terminal coupled to said second current electrode of said first pass transistor, a second terminal coupled to said feedback terminal, and a control terminal for receiving a voltage select signal, wherein said first resistor is a variable resistor and said voltage select signal selects a resistance of said first resistor; and a second resistor having a first terminal coupled to said second terminal of said first resistor, and a second terminal coupled to a ground voltage terminal.

20. The adaptable LDO regulator of claim 18, wherein said second pass transistor comprises:

a base transistor having a first current electrode for receiving said input voltage, a control electrode coupled to said output of said error amplifier, and a second current electrode for providing said output voltage; and a plurality of selectable transistors each having a first current electrode for receiving said input voltage, a control electrode selectively coupled to said output of said error amplifier according to a corresponding select signal, and a second current electrode coupled to said second current electrode of said base transistor.

21. The adaptable LDO regulator of claim 20, further comprising:

a selectable resistance having a first terminal coupled to said second current electrode of said second pass transistor, a second terminal coupled to a ground voltage terminal, and a control terminal for receiving a select signal.

22. A method comprising:

providing an error voltage in response to a difference between a feedback voltage and a reference voltage;

controlling a conductivity of a first pass transistor in response to said error voltage, said first pass transistor having a first current electrode for receiving an input voltage and a second current electrode;

controlling a conductivity of a second pass transistor in response to said error voltage, said second pass transistor having a first current electrode for receiving said input voltage and a second current electrode providing an output voltage;

in a closed loop mode:

directly and electrically coupling said second current electrodes of said first pass transistor and said second pass transistor together; and dividing said output voltage and providing said feedback voltage in response thereto, and in an open loop mode:

decoupling said second current electrode of said first pass transistor from said second current electrode of said second pass transistor; and dividing a voltage on said second current electrode of said first pass transistor, and providing said feedback voltage in response thereto.

23. The method of claim 22, further comprising:

setting an effective size of said second pass transistor to be N times larger than an effective size of said first pass transistor, wherein N is an integer greater than one.

24. The method of claim 23, wherein setting said effective size of said second pass transistor comprises:

coupling M transistors in parallel, wherein each of said M transistors has a first current electrode for receiving said input voltage, and a second current electrode coupled to second current electrodes of each other one of said M transistors and providing said output voltage; and trimming said effective size of said second pass transistor by selecting individual ones of said M transistors and disabling other ones of said M transistors.

25. The method of claim 23, further comprising:

coupling a programmable resistor between said second current electrode of said second pass transistor and a ground voltage terminal; and setting an equivalent resistance of said programmable resistor according to an output current select signal.

26. The method of claim 22, further comprising:

in said open loop mode:

lowpass filtering said error voltage and providing a filtered error voltage in response thereto, wherein controlling said conductivity of said first pass transistor comprises controlling said conductivity of said first pass transistor in response to said filtered error voltage.

27. The method of claim 22, further comprising:

dividing said output voltage to provide said feedback voltage using a resistive divider; and setting a divide ratio of said resistive divider in response to an output voltage select signal.

28. The method of claim 22, further comprising:

in a tracking mode:

setting said reference voltage dynamically according to a sum of a P-channel transistor threshold plus an N-channel transistor threshold; and in a normal operation mode:

setting said reference voltage statically to a predetermined voltage.

* * * * *